United States Patent [19]

Melendez et al.

[11] Patent Number: 4,752,264

[45] Date of Patent: Jun. 21, 1988

[54] WARNING FLAG FOR SKIERS

[76] Inventors: Alfred G. Melendez, 830 S. Gates; Larry P. Perez, 1202 Elliot Pl., both of Santa Ana, Calif. 92704

[21] Appl. No.: 916,868

[22] Filed: Oct. 9, 1986

[51] Int. Cl.[4] ..... B63C 9/20

[52] U.S. Cl. ..... 441/89; 2/DIG. 6; 116/173

[58] Field of Search ..... 441/65, 68, 80, 88, 441/89, 106, 108, 111, 114–119; 116/173, 174; 2/94, 44–45, DIG. 6; 224/186–190

[56] References Cited

U.S. PATENT DOCUMENTS

| | | | |
|---|---|---|---|
| 653,201 | 7/1900 | Ancevine | 441/89 |
| 853,397 | 5/1907 | Butler | 224/190 |
| 2,118,708 | 5/1938 | Johnson | 441/111 |
| 3,646,626 | 3/1972 | Frieder | 441/115 |
| 3,872,529 | 3/1975 | Wainwright | 116/173 X |
| 3,946,699 | 3/1976 | Mirshak | 116/174 |
| 3,973,643 | 8/1976 | Hutchinson | 2/94 X |
| 4,035,856 | 7/1977 | Oberg | 441/89 |
| 4,416,212 | 11/1983 | Howard | 441/80 X |
| 4,598,661 | 7/1986 | Roe | 441/89 X |

*Primary Examiner*—Joseph F. Peters, Jr.
*Assistant Examiner*—Paul E. Salmon
*Attorney, Agent, or Firm*—Roy A. Ekstrand

[57] ABSTRACT

A warning flag for skiers includes a flexible mast attached to the skier's life jacket at the approximate center of the jacket's rear portion. The flexible mast extends upwardly from the life jacket for a substantial distance beyond the highest point of the skiers head and terminates in a high visibility warning flag at its upper end.

6 Claims, 2 Drawing Sheets

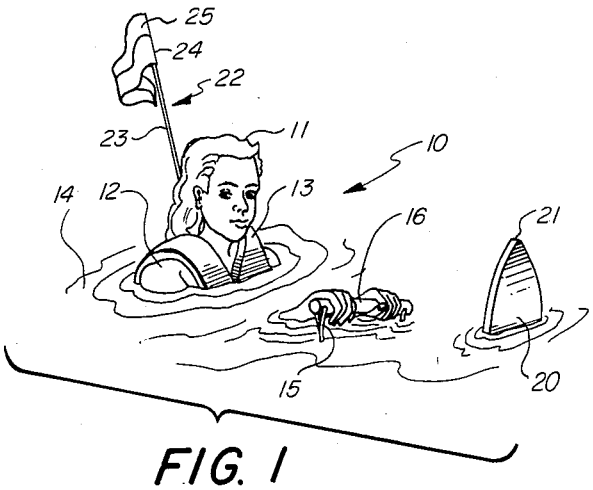
FIG. 1
FIG. 2
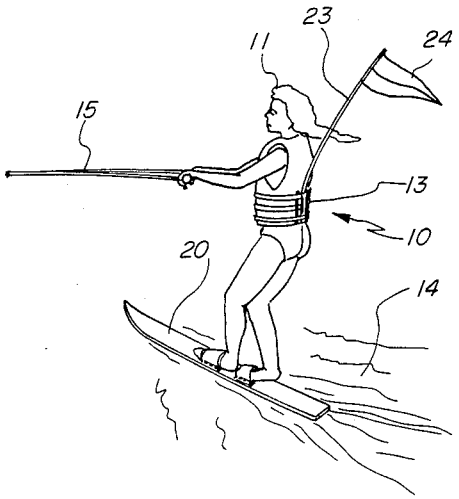
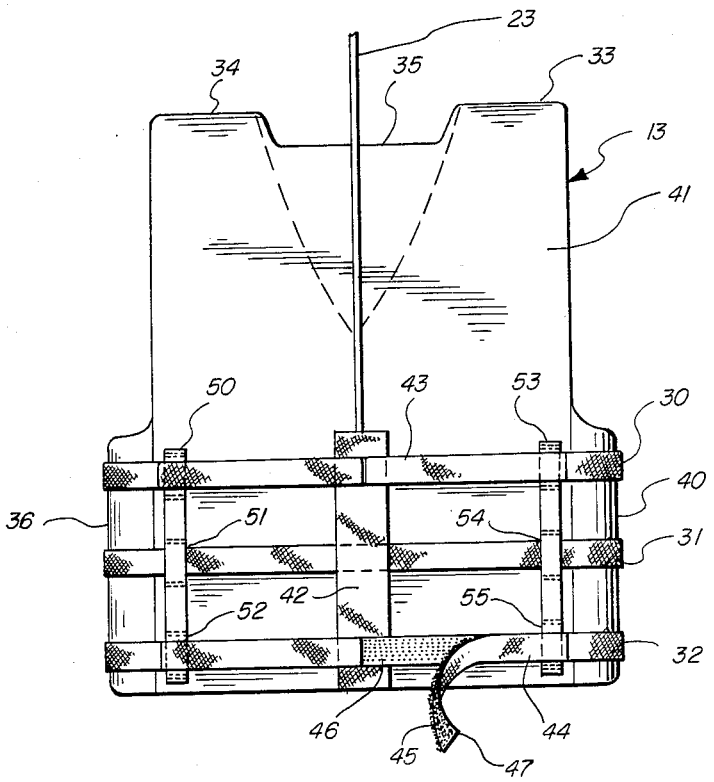
FIG. 3

WARNING FLAG FOR SKIERS

FIELD OF THE INVENTION

This invention relates generally to water safety devices and particularly for those applicable to participants in water skiing and jet ski activities.

BACKGROUND OF THE INVENTION

Through the years, the sport of water skiing has become increasingly popular among water sport enthusiasts. While styles of water skiing and the types of equipment used vary somewhat, water skiing may be generalized as the activity in which a skiier is supported on a single ski or pair of skis and is pulled across the surface of the water by a tow rope attached to a power boat. The skier skims the water surface on the skis and is able to move relative to the power boat to some degree. While the primarly intended activity of the water skier is that of skimming or riding across the water surface, necessarily the skier begins by resting in the water and assumes the starting position in which the skis are extended nearly vertically in the water and the skier grasps the tow rope and the power boat is at idle. During this interval of time, the skier floats with only his or her head and the top of his or her shoulders above the water. The ski run is initiated by the pilot of the boat excelerating with sufficient power to pull the skier into the upright skiing position. In addition to thise starting procedure being utilized at the beginning of any skiers activity, frequently skiers are subject to falling during the skiing process. In such event, the skier releases the tow rope and comes to rest within the water and if necessary, retrieves his or her skis and waits for the return of the boat. In the meantime, the pilot of the boat having become aware of the skiers fall makes a large looping turn with the tow rope trailing behind and returns to the skier whereupon the above-described starting position is assumed and the skier is once again pulled into the upright position during the starting procedure.

In a somewhat similar activity, the sport or jet skiing has become increasingly popular in recent years. Unlike conventional water skiing, jet skiing is undertaken with a motorized jet ski device which in essence is similar to a small powered boat adapted to be steered and driven by one or more standing jet skiers. In jet skiing, the entire motorized jet ski is driven across the surface of the water in a skimming action and unlike conventional water skiing in which a skier is towed behind the power boat, the jet ski is riden across the water surface by one or more standing jet skiers. Frequently, jet skiers lose their balance or suffer some mishap which results in the jet skier falling into the water and being separated from the powered jet ski device. Generally, during such falls the jet ski device, due to its power and momentum, carries forward some small distance from the jet skier and thereafter automatically initiates a programmed slow circuling motion intended by its design to bring the jet ski slowly back to the jet skier. For safety reasons the programmed circular travel of the jet ski is undertaken at an extremely slow speed. As a result, there is a frequently some time spent by the jet skier awaiting the return of the jet ski.

Because both the sports of water skiing and jet skiing are frequently participated in water ways used by power boats, including high speed power boats, the participants in water skiing and jet skiing are subject to similar hazards which arise during the time they spend floating in the water. While jet skiers and water skiers are highly visible and highly mobile when traveling across the water surface and are therefore likely to be seen by other power boat pilots and may readily be capable of avoiding collision with such power boats, when resting in the water they are difficult to see and experience difficulty in moving out of harms way. As a result, a water skier or jet skier floating in the water is subject to substantial risk of being struck by other speeding power boats.

Some attempts have been made to reduce this risk through the use of brightly colored life jackets, hats or vests by jet skiers and water skiers. While such measures result in some increase in the visibility of water skiers and jet skiers while resting in the water, the problem continues to be the extremely low profile which the skier presents to other boats.

Accordingly, there remains a need in the art for an improved safety factor for water skiers and jet skiers while floating between skiing runs which does not unduly encumber or interfere with the jet skier or water skiers normal activities.

SUMMARY OF THE INVENTION

It is a general object of the present invention to provide an improvement in the safety accorded jet skiers and water skiers while resting in the water between ski runs. It is a more particular object of the present invention to provide an improved means for increasing the visibility of such skiers to the pilots of boats in the region of the skiers. It is a still more particular object of the present invention to provide an improvement in the safety accorded skiers between ski runs by increasing the visible profile height of such skiers as they float in the water.

In accordance with the present invention, there is provided a warning flag for skiers in which a flexible mast is attached to the skier's life jacket at the approximate center of the jacket's rear portion. The flexible mast extends upwardly from the life jacket for a substantial distance beyond the highest point of the skiers head and terminates in a high visibility warning flag at its upper end.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings in the several figures of which like reference numerals identify like elements and in which.

FIG. 1 is a pictorial view of a typical water skier in the starting position;

FIG. 2 is a pictorial view of a typical water skier in the upright skiing position.

FIG. 3 is a rear elevation view of the present invention warning flag for skiers secured to a conventional skier's flotation vest;

DESCRIPTION OF THE PREFERRED EMBODIMENTS

Figure 4:
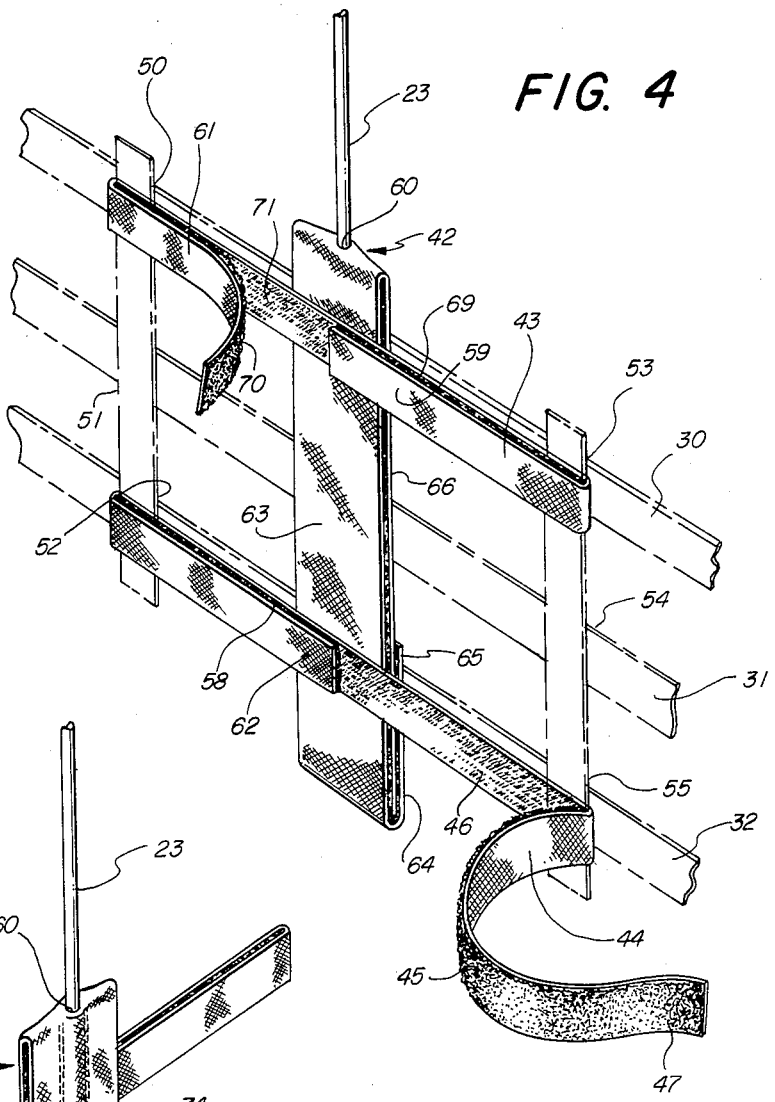
FIG. 4 is a pictorial view of the outer portion of the present invention warning flag for skiers during its attachment to the vest of FIG. 2.

FIG. 1 shows a pictorial view of a water skier assuming the starting position described above in which the skier, generally referenced by the reference numeral 10, floats largely beneath the water surface 14 such that the skiers head 11 and the shoulder portion 12 extends above water surface 14. In addition, skier 10 wears a life jacket 13 which assists in the flotation of skier 10. A tow rope 15 which is secured to a typical power boat of the type used to tow skiers (not shown), terminates in a handle 16 which skier 10 grasps in order to be pulled by the power boat. Skier 10 is employing a single water ski 20 having a ski tip 21 extending above water surface 14 in the position shown. The importance of FIG. 1 is to point out that a relatively small portion of the anantomy of skier 10 extends above water surface 14 as skier 10 rests or floats within the water. Accordingly, it will be apparent that the profile against water surface 14 presented by skier 10 contributed by the skier's head 11 and shoulder portion 12 is relatively small and as can be anticipated, a skier in the position shown in FIG. 1 is, as mentioned above, relatively hard to observe from nearby speeding power boats.

In accordance with an important aspect of the present invention, a safety flag 22 is worn by skier 10 and by means set forth below in greater detail, is secured to life jacket 13. Safety flat 22 includes a flexible mast 23 which extends upwardly from life jacket 13 beyond the top of the skier's head 11 a significant distance terminating in a mast end 25 which typically is somewhere between 1½ and 3 feet above the top of skier's head 11. In accordance with the invention, safety flag 22 further includes a warning flag 24 secured to flexible mast 23 at mast end 25 by means set forth below in greater detail. While warning flag 24 may take any number of shapes and sizes without departing from the spirit and scope of the present invention, in its preferred form, warning flag 24 is fabricated of a high visibility material and selected color or colors which cooperate to increase the striking visibility of safety flag 22. As will be apparent to those skilled in the art, the presence of warning flag 24 supported above the head 11 of skier 10 substantially increases the visibility presented by skier 10 and increases the likelihood that nearby boat pilots will have their attention drawn to the presence of skier 10 in the water at sufficient distances to permit such boat pilots to avoid skier 10.

FIG. 2 shows a typical water skier 10 in the position assumed during actual skiing in which skier 10 rides upon water surface 14 using water ski 20 in accordance with conventional water skiing practices. Tow rope 15, as mentioned, provides a coupling by which a typical motor power boat (not shown) propells skier 10 across water surface 14. Skier 10 continues to wear life jacket 13 and the attached flexible mast 23 of safety flag 22. The important aspect to observe in FIG. 2 is that the forward motion of skier 10 across water surface 14 in accordance with normal water skiing activity, produces an opposite direction wind resistance which tends to pull warning flag 24 rearward from skier 10. Because of the flexibility of flexible mast 23, the wind resistance of warning flag 24 causes flexible mast 23 to curve rearward and moves the relative position of warning flag 24 and flexible mast 23 rearwardly away from the body of skier 10. In accordance with an important aspect of the present invention, the flexibility of mast 23 and the wind resistance of warning flag 24, cooperate with the wind produced by the motion of skier 10 to virtually remove warning flag 24 from the field of vision of skier 10. Simply stated, the wind resistance pulls warning flag 24 out of the field of vision of skier 10 and avoids any interference which the fluttering of the flag 24 might otherwise cause to the skier 10.

FIG. 3 shows a rear view of life jacket 13 having safety flag 22 secured thereto. In accordance with customary fabrication of such life jackets, life jacket 13 comprises a substantially flat jacket back 41 which is sized to fit within the shoulder span of the wearer and which terminates on its upper end in a neck opening 35 and a pair of shoulder coverings 33 and 34. Neck opening 35 accommodates the insertion of the skier's head therethrough and permits shoulder coverings 33 and 34 to rest upon the skier's shoulders. Life jacket 13 further comprises a pair of wrap around side portions 36 and 40 which extend about the approximate midrif portion of the skier and which meet at the approximate midpoint of the frontal abdomen surface of the skier. In accordance with typical construction of such life jackets, life jacket 13 further includes a trio of lateral straps 30, 31 and 32 which extend about the entire surface of jacket back 41 and jacket sides 36 and 40. While not shown in FIG. 3, it should be understood that in accordance with generally accepted fabrication techniques, lateral straps 30, 31 and 32 each terminate in suitable buckling mechanisms which permit the wearer of jacket 13 to draw lateral straps 30, 31 and 32 tightly together and thereby secure life jacket 13 to the upper body of the wearer. Life jacket 13 further includes a trio of vertical spacing loops 50, 51 and 52 which are secured to jacket back 41 and spaced apart by substantially even distances. Loops 50, 51 and 52 are fabricated such that lateral straps 30, 31 and 32 may pass through loops 50, 51 and 52 respectively thereby maintaining the relative positions in the vertical direction of lateral straps 30, 31 and 32. Similarly, a second trio of vertical spacing loops 53, 54 and 55 are similarly situated on the opposite side of jacket back 41. Lateral straps 30, 31 and 32 also pass through loops 53, 54 and 55 respectively which further maintains the appropriate spacing and positions of lateral straps 30, 31 and 32. While life jacket 13 may include other similarly fabricated trios of vertical spacing loops either on sides 36 and 40 or on other portions of life jacket 13, they do not concern the present invention safety flag and therefore are not shown in FIG. 3. It will also be apparent to those skilled in the art that one or more additional trios of vertical spacing loops may be situated between the trios of loops shown in FIG. 3 without departing from the spirit and scope of the present invention.

Safety flag 22 includes a mast strap 42 which, as better seen in FIGS. 4 and 5 below, comprises a multi-layered substantially flat member fabricated of a flexible strong material such as canvas or man made fabric. By means set forth below in greater detail, mast strap 42 supports flexible mast 23 and provides a means of attachment by which mast 23 is attached to lateral straps 30, 31 and 32. A pair of transverse straps 43 and 44 are attached to mast strap 42 and extend outwardly therefrom. Transverse strap 43, by means set forth below in greater detail, mast strap 42 captivates lateral straps 30, 31 and 32 between its layers and thereby securely attaches mast strap 42 to lateral straps 30, 31 and 32. Transverse strap 44 is attached to the outer layer of mast strap 42 and extends outwardly in both directions therefrom and passes through loops 52 and 55. Transverse strap 44, after passing through loops and 55, is folded inwardly upon itself and is secured to the remaining portions of transverse strap 44 by a Velcro fastener attachment. By way of example, end 47 of transverse strap 44 is shown partially removed from this Velcro fastener attachment. In accordance with the known Velcro fastener attachment fabrication, a Velcro fastener pad 46 is secured to the underlying portion of transverse strap 44 and a corresponding Velcro fastener pad 45 is secured to end 47 of transverse strap 44. While any number of attachment mechanisms for securing the ends of transverse strap 44 to the portion secured to mast strap 42 may be utilized without departing from the present invention, it has been found advantageous to utilize a Velcro fastener pad 46 which comprises a plurality of Velcro fastener hooks and a corresponding Velcro fastener pad 45 which comprises a plurality of Velcro fastener loop fabric portions which cooperate to form a secure attachment when pressed together.

Similarly, transverse strap 43 is attached at its center to mast strap 42 and extends outwardly therefrom through loops 50 and 53 and is folded back on the outside of loops 50 and 53 to be secured to the interior portion of transverse strap 43 by a similar Velcro fastener attachment to that described below for transverse strap 44. The resulting attachment of mast strap 42 tightly secures flexible mast 23 to life jacket 13 and maintains the position thereof against jacket back 41. Because of the multiple attachment of mast strap 42 and transverse straps 43 and 44 which utilizes both lateral straps 30 through 32 and loops 50 through 55 of life jacket 13, flexible mast 23 and thereby warning flag 24 are securely maintained and may withstand substantial wind forces upon warning flag 24 without altering the postion of flexible mast 23. In addition, it will be apparent to those skilled in the art that the means of attachment utilized by the present invention safety flag can readily accommodate a variety of spacings between loops 50 through 55 and, as shown below in greater detail, can also accommodate a variety of spacings between lateral straps 30 through 32. Accordingly, the present invention safety flag may be securely fastened to life jackets having a variety of constructions and sizes.

Because of the multiple use of Velcro fastener type fasteners in securing the present invention safety flag to life jacket 13, the safety flag may readily be removed from life jacket 13 by simply pulling back the ends of transverse straps 43 and 44 and removing them from loops 50 through 55 and thereafter separating mast strap 42 from lateral straps 30 through 32 by means shown below in greater detail. Suffice it to note here however that the present invention safety flag may be completely removed from or attached to life jacket 13 without the need of altering the structure of the life jacket.

It will be apparent however to those skilled in the art that the structure of life jacket 13 may, if desired, be altered to accommodate the attachment of flexible mast 23 by virtually any number of attachment systems. For example, life jacket 13 may accommodate a built in receptacle for flexible mast 23 which would remove the need for mast strap 42 and transverse straps 43 and 44. This receptacle, in its simpliest form for constructions of life jacket 13 which comprise layers of fabric supporting flotation pads therein, may simply comprise a sewn elongated pocket which receives flexible mast 23. Similarly, for constructions of life jacket 13 which comprise the popular molded plastic fabrication, a suitable elongated pocket receptor for flexible mast 23 may be molded into the back portion of life jacket 13 and used to receive and support flexible mast 23.

Figure 5:
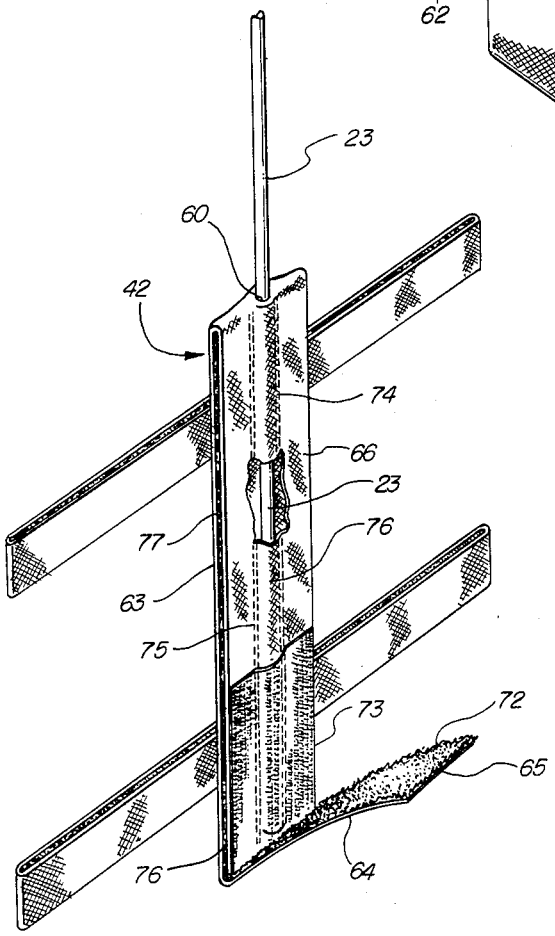
FIG. 5 is a pictorial view of the mast attaching portion of the present invention warning flag for skiers.

FIG. 4 sets forth a pictorial view of the outer portion of the attachment means of the present invention safety flag. For purposes of illustration and clarity, the details of life jacket 13 are not shown in FIG. 4 due to its enlargement and lateral straps 30, 31 and 32 of life jacket 13 are shown in dashed line representation. Similarly, loops 50 through 55 are shown in dashed line representation. As described above, transverse strap 43 defines a Velcro fastener pad 71 extending across a substantial portion of its center. Transverse strap 43 further defines a pair of cooperating Velcro fastener pads 69 and 70 attached to the undersides of ends 59 and 61 of transverse strap 43. In accordance with the invention, transverse strap 43 is secured after passing through loops 50 and 53 by drawing ends 59 and 61 inwardly and pressing together pads 70 and 71 and pads 69 and 71 to secure transverse strap 43. Transverse strap 44 is similar in construction to transverse strap 43 and defines ends 47 and 62 which in turn define interior Velcro fastener pads 45 and 58 respectively which are similarly secured to Velcro fastener pad 46. As will be apparent from examination of FIG. 4 and as mentioned above, the means of attachment utilized in folding transverse straps 43 and 44 inwardly and pressing together the appropriate Velcro fastener pad attachment means permits transverse straps 43 and 44 to accommodate a wide range of spacings between loops 50 and 53 and between loops 52 and 55. As is also seen in FIG. 4, mast strap 42 comprises a first layer 63 which is attached to the center portions of transverse straps 43 and 44 by any convenient means such as sewing or adhesives. Mast strap 42 further includes a second layer 66 which is folded upon layer 63 and which defines an aperture 60 through which flexible mast 23 extends. A third layer 64, which is in effect the end portion of layer 63 wrapped around the bottom portion of layer 66, terminates in an end 65 which is attached to layer 66 by a Velcro fastener pad attachment shown below in FIG. 5. With simultaneous reference to FIGS. 4 and 5, the attachment of mast strap 42 to mast 23 may be better seen. As mentioned, mast strap 42 defines a first layer 63 attached to transverse straps 43 and 44, a second layer 66 which defines an aperture 60 and a third layer 64 which terminates in an end 65. End 65 is secured to layer 66 by a Velcro fastener pad 73 and a Velcro fastener pad 72. A pair of substantially parallel seams 74 and 75 extend virtually the entire length of layer 66 and pass through layer 66 and pad 77. The latter is attached to layer 66. Aperture 60 and seams 74 and 75 cooperate to form an elongated pocket 76 which receives mast 23 and secures it to layer 66. In accordance with an important aspect of the present invention and because layers 63, 66 and 64 are secured by means of Velcro fastener pads 77, 72 and 73, layers 66 and 63 may be separated during the attachment of mast strap 42 to life jacket 13 and encircle lateral straps 30, 31 and 32 to further secure mast strap 42 to life jacket 13. With layers 63 and 66 separated and passed on opposite sides of lateral straps 30, 31 and 32 and then pressed together to secure pad 77 in an attachment of layers 66 and 63, lateral straps 30, 31 and 32 are captivated securely between layers 66 and 63. Thereafter, layer 64 is folded over layer 66 and secured thereto by the cooperation of pads 72 and 73.

As will be apparent to those skilled in the art, the attachment means of the present invention warning flag for skiers provides a ready attachment to and separation from a conventional life jacket. It will be further apparent that the attachment means the present invention warning flag for skiers readily compensates for different constructions of life jackets and facilitates a variety of life jacket strap arrangements.

It should also be noted that while the exemplary uses of the present invention set forth are those of water skiers and jet skiers, the invention may readily be utilized by participants in other water sports or activities to enhance visibility and improve safety of the wearer.

While particular embodiments of the present invention have been shown and described, it will be obvious to those skilled in the art that changes and modifications may be made without deparing from the invention in its broader aspects. Therefore, the aim in the appended claims is to cover all such changes and modifications as fall within the true spirit and scope of the present invention.

That which is claimed is:

1. A warning flag for use by a wearer in combination with a flotation jacket having a back surface and a plurality of jacket belts for attachment to the wearer including a plurality of transverse securing belts horizontally encircling said jacket, said warning flag comprising:

a flexible mast having first and second ends;

a generally planar flag secured to said first end; and securing means for attaching said second end to said back surface such that said flexible mast extends upwardly therefrom to flexibly support said flag above said jacket, said securing means having a center portion attached to said second end of said flexible mast and a plurality of strap members, each supporting a hook pad and a loop pad, extending outwardly from said center portion and including a plurality of transverse securing belts horizontally encircling said jacket, said center portion defining a flat elongated member having an interior surface and first and second end portions and an elongated center pocket extending across said interior surface and receiving said second end of said flexible mast, said first and second end portions of said center portion folding over said transverse belts to secure said center portion thereto.

2. A warning flag for skiers as set forth in claim 1 wherein said interior surface supports an elongated hook pad and wherein said first and second ends each support loop pads, said hook and loop pads cooperating to secure said first and second end portions to said interior surface and captivate said transverse belts.

3. A warning flag for skiers as set forth in claim 1 wherein said interior surface supports an elongated loop pad and wherein said first and second ends each support hook pads, said hook and loop pads cooperating to secure said first and second end portions to said interior surface and captivate said transverse belts.

4. A warning flag for skiers as set forth in claim 1 wherein said flexible mast defines a circular cross-section of fiber glass material and said flag defines a flexible sheet secured to said first end.

5. A warning flag for skiers as set forth in claim 4 wherein said flag is colored with a luminiscent color to increase its visibility.

6. A warning flag for skiers as set forth in claim 1 wherein said back surface of said jacket includes a plurality of vertical loops and said transverse belts pass through respective ones of said loops and wherein said strap members each pass through respective ones of said loops.

* * * * *